US010196114B2

(12) United States Patent
Peace et al.

(10) Patent No.: US 10,196,114 B2
(45) Date of Patent: Feb. 5, 2019

(54) FLOATING PRODUCTION UNIT AND METHOD OF INSTALLING A FLOATING PRODUCTION UNIT

(71) Applicant: CRONDALL ENERGY CONSULTANTS LTD., Winchester, Hampshire (GB)

(72) Inventors: Duncan Peace, Winchester (GB); Ramon Kunkeler, Winchester (GB); Engin Balli, Winchester (GB)

( * ) Notice: Subject to any disclaimer, the term of this patent is extended or adjusted under 35 U.S.C. 154(b) by 0 days.

(21) Appl. No.: 15/572,934

(22) PCT Filed: May 12, 2016

(86) PCT No.: PCT/GB2016/051377

§ 371 (c)(1),
(2) Date: Nov. 9, 2017

(87) PCT Pub. No.: WO2016/181159

PCT Pub. Date: Nov. 17, 2016

(65) Prior Publication Data

US 2018/0141625 A1 May 24, 2018

(30) Foreign Application Priority Data

May 13, 2015 (GB) ..... 1508165.6

(51) Int. Cl.
*E21B 17/01* (2006.01)
*E21B 19/00* (2006.01)
(Continued)

(52) U.S. Cl.
CPC ..... *B63B 39/005* (2013.01); *B63B 1/048* (2013.01); *B63B 9/065* (2013.01);
(Continued)

(58) Field of Classification Search
CPC ..... E21B 17/01; E21B 17/02; E21B 19/006; E21B 43/0107; E21B 43/013;
(Continued)

(56) References Cited

U.S. PATENT DOCUMENTS 633,642 A 9/1899 Evans
3,472,032 A * 10/1969 Howard ..... E21B 43/01 114/264
(Continued)

FOREIGN PATENT DOCUMENTS

AU 666742 2/1994
AU 1998068767 10/1998
(Continued)

OTHER PUBLICATIONS

"The Dominance of FPSO", Offshore Technology, Aug. 29, 2008. Retrieved on Feb. 19, 2015 from http://www.offshore-technology.com/features/feature40937/.

*Primary Examiner* — Matthew R Buck
(74) *Attorney, Agent, or Firm* — John L. Rogitz

(57) ABSTRACT

The present disclosure relates to an unmanned floating production unit (300) and method of installing a floating production unit comprising a deck structure (301) for mounting equipment for processing hydrocarbons, and a hull structure (302) formed from a first section (303) and a second section (306), wherein the second section (306) is wider than the first section (303). The floating production unit (300) according to the present disclosure can provide a compact unit, which has dimensions which can lead to a heave natural period outside an area of significant wave energy, and as a result, it has substantially reduced and improved hydrodynamic responses. The floating production unit is configured to be small and lightweight, and can be fabricated, launched and towed to the installation site in two parts, without the requirement for heavy lifting or construc-
(Continued)

tion machinery, thus lowering manufacturing costs. In addition, the two parts of the floating production unit can be joined together at the installation site using a buoyancy and ballasting based technique. The floating production unit is designed to be unmanned during routine production operations, thus ensuring operating costs are low.

21 Claims, 6 Drawing Sheets

(51) Int. Cl.

| | |
|---|---|
| ***B63B 35/44*** | (2006.01) |
| ***B63B 39/00*** | (2006.01) |
| ***B63B 1/04*** | (2006.01) |
| ***B63B 9/06*** | (2006.01) |
| ***B63B 39/03*** | (2006.01) |
| ***E21B 17/02*** | (2006.01) |
| ***E21B 43/013*** | (2006.01) |
| ***E21B 43/12*** | (2006.01) |

(52) U.S. Cl.
CPC ..... *B63B 35/4413* (2013.01); *B63B 39/03* (2013.01); *E21B 17/02* (2013.01); *E21B 19/006* (2013.01); *E21B 43/013* (2013.01); *E21B 43/121* (2013.01); *B63B 2001/044* (2013.01); *B63B 2009/067* (2013.01); *B63B 2035/448* (2013.01)

(58) Field of Classification Search
CPC ... E21B 43/121; B63B 9/065; B63B 35/4413; B63B 39/03; B63B 39/005
See application file for complete search history.

(56) References Cited

U.S. PATENT DOCUMENTS

| | | | | |
|---|---|---|---|---|
| 3,572,041 | A | 3/1971 | Graaf | |
| 4,606,673 | A | 8/1986 | Daniell | |
| 5,012,756 | A | 5/1991 | Kristensen | |
| 5,609,442 | A | 3/1997 | Horton | |
| 5,706,897 | A | 1/1998 | Horton | |
| 6,092,483 | A | 7/2000 | Allen et al. | |
| 6,139,224 | A | 10/2000 | Michel et al. | |
| 6,155,193 | A | 12/2000 | Syvertsen et al. | |
| 6,263,824 | B1 | 7/2001 | Balint et al. | |
| 6,340,272 | B1 | 1/2002 | Runge et al. | |
| 6,371,697 | B2 * | 4/2002 | Huang | B63B 1/048 114/264 |
| 6,471,444 | B1 | 10/2002 | Pollack | |
| 6,761,508 | B1 | 7/2004 | Haun | |
| 6,786,679 | B2 * | 9/2004 | Huang | B63B 1/048 114/264 |
| 6,945,736 | B2 | 9/2005 | Smedal et al. | |
| 6,968,797 | B2 | 11/2005 | Persson | |
| 7,044,072 | B2 | 5/2006 | Converse et al. | |
| 7,101,117 | B1 | 9/2006 | Chow | |
| 7,255,517 | B2 * | 8/2007 | Basak | B63B 21/50 405/205 |
| 7,278,801 | B2 * | 10/2007 | Chianis | B63B 9/065 405/223.1 |
| 7,467,913 | B1 | 12/2008 | Allen et al. | |
| 7,717,762 | B2 | 5/2010 | Boatman et al. | |
| 7,958,835 | B2 | 6/2011 | Srinivasan | |
| 7,959,480 | B2 | 6/2011 | Lindblade | |
| 8,418,639 | B2 | 4/2013 | Hooper et al. | |
| 8,544,402 | B2 | 10/2013 | Vandenworm | |
| 8,544,404 | B2 | 10/2013 | Costa et al. | |
| 8,613,570 | B2 | 12/2013 | Westre | |
| 8,807,062 | B2 | 8/2014 | Tahar et al. | |
| 8,881,826 | B2 | 11/2014 | Crome et al. | |
| 9,079,644 | B2 | 7/2015 | Aarsnes et al. | |
| 2002/0197116 | A1 * | 12/2002 | Zou | B63B 1/048 405/224.2 |
| 2004/0123552 | A1 | 7/2004 | Zeeman et al. | |
| 2004/0159276 | A1 * | 8/2004 | Persson | B63B 9/065 114/264 |
| 2006/0039758 | A1 | 2/2006 | Leverette et al. | |
| 2006/0225634 | A1 | 10/2006 | Cho et al. | |
| 2008/0014024 | A1 | 1/2008 | Lokken et al. | |
| 2008/0099208 | A1 | 5/2008 | Moncus et al. | |
| 2010/0150660 | A1 | 6/2010 | Nadarajah et al. | |
| 2011/0142545 | A1 | 6/2011 | Leverette et al. | |
| 2015/0064996 | A1 | 3/2015 | Vandenworm | |

FOREIGN PATENT DOCUMENTS

| | | | |
|---|---|---|---|
| AU | 1998088166 | A1 | 3/1999 |
| AU | 19980085179 | | 4/1999 |
| AU | 2012213486 | | 12/2015 |
| BG | 63530 | | 10/2000 |
| BR | PI0619240 | A2 | 1/2013 |
| CA | 2210302 | A1 | 8/1996 |
| CA | 2593874 | A1 | 2/2008 |
| CA | 2723410 | | 4/2015 |
| CN | 1052696 | A | 7/1991 |
| CN | 1175232 | A | 3/1998 |
| CN | 201545178 | U | 8/2010 |
| CN | 102216153 | A | 10/2011 |
| CN | 102795317 | A | 11/2012 |
| CN | 104029798 | A | 9/2014 |
| CN | 102756793 | B | 5/2015 |
| EP | 0256177 | A1 | 2/1988 |
| EP | 951420 | A1 | 10/1999 |
| EP | 0784562 | B1 | 6/2000 |
| EP | 0959182 | B1 | 4/2003 |
| EP | 1075584 | B1 | 10/2009 |
| EP | 2204497 | B1 | 1/2012 |
| GB | 2008051 | A | 5/1979 |
| GB | 2253813 | A | 9/1992 |
| GB | 2256620 | A | 12/1992 |
| GB | 2256620 | B | 5/1995 |
| GB | 2285017 | A | 6/1995 |
| GB | 2292348 | A | 2/1996 |
| GB | 2311319 | A | 9/1997 |
| GB | 2372965 | A | 9/2002 |
| GR | 1006527 | | 9/2009 |
| IN | 200701853 | P4 | 10/2004 |
| IN | 201008012 | P1 | 11/2013 |
| KR | 460728 | B1 | 12/2004 |
| KR | 20060098385 | A | 9/2006 |
| KR | 2009003615 | | 12/2010 |
| KR | 20120031043 | A | 3/2012 |
| KR | 20150043828 | A | 4/2015 |
| KR | 2015008028 | | 2/2017 |
| MY | 132193 | A | 9/2007 |
| RU | 2256745 | C1 | 7/2005 |
| SG | 166381 | A1 | 12/2009 |
| SG | 166381 | B | 12/2009 |
| SG | 171756 | A1 | 7/2011 |
| SG | 175061 | B | 11/2011 |
| SG | 20110072378 | | 11/2011 |
| VN | 26763 | A | 7/2011 |
| WO | 2000066874 | A1 | 11/2000 |
| WO | 2001015968 | A1 | 3/2001 |
| WO | 2000066871 | A3 | 4/2001 |
| WO | 2002092425 | A1 | 11/2002 |
| WO | 2003016714 | A1 | 2/2003 |
| WO | 2004080791 | A1 | 9/2004 |
| WO | 2006066871 | A1 | 6/2006 |
| WO | 2008115068 | A1 | 9/2008 |
| WO | 2007127531 | A3 | 4/2009 |
| WO | 2012104309 | A2 | 8/2012 |
| WO | 2013022484 | A1 | 2/2013 |
| WO | 2014059784 | A1 | 4/2014 |
| WO | 2014108432 | A1 | 7/2014 |

* cited by examiner

FLOATING PRODUCTION UNIT AND METHOD OF INSTALLING A FLOATING PRODUCTION UNIT

TECHNICAL FIELD OF THE DISCLOSURE

The present disclosure relates to floating production units, including equipment for processing hydrocarbons, which are configured to be not normally manned when in use.

Embodiments of the present technique can provide methods of installing the floating production unit, at an offshore location without the requirement for large and expensive construction equipment.

BACKGROUND OF THE DISCLOSURE

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present disclosure.

The extraction and processing of hydrocarbons, particularly crude oil and natural gas, is an essential process necessitated by the world's increasing demand for fossil fuels of various compositions. The limited supply of oil and natural gas means that it is necessary to undergo continuous exploration in order to identify new oil and gas reserves, which are often situated in deep subsea locations.

Offshore oil and gas production platforms are generally very large structures which possess the capability and equipment to produce oil and gas from wells drilled into the sea bed, and either process it or store it until it can be taken to the shore. The first oil platforms were built and operated towards the end of the $19^{th}$ century, and were able to extract hydrocarbons from shallow offshore wells.

As technology has advanced and the demand for oil and natural gas has risen, oil platforms have been operated in increasingly deep waters, to the point at which it has started to become technically and commercially unfeasible to fix the platforms to the sea bed. The first floating production unit (FPU) was developed in 1975 when the Argyll field in the UK North Sea was developed using a converted semi-submersible drilling rig, known as the Transworld 58. Two years later, in 1977, the first FPU based on a converted tanker was installed on the Shell Castellon field, extracting hydrocarbons from waters over 100 m off the coast of Spain. The use of a tanker hull allowed for produced oil to be stored on board and subsequently offloaded to a separate trading tanker. These converted tanker units were christened floating production storage and offloading units, or FPSOs.

A proliferation in deep water exploration and drilling over the past few years has resulted in a large number of new discoveries, which will now require development solutions. Market forecasts suggest that there are many offshore oil and gas projects in the planning and study phases which will require floating production units over the next several years. A significant number of these discoveries are relatively small fields which will be economically marginal compared to larger fields, and reductions in scale and cost of existing technologies, such as FPSOs, has not been able to deliver a sufficiently cost effective solution to produce and exploit these smaller fields. It is therefore necessary for an entirely new technology to be developed.

The objective technical problem addressed by the present disclosure, then, is the development of a compact, not normally manned floating production unit to be used for smaller offshore developments where the use of one of the existing larger scale manned floating production unit technologies is not cost effective. The process of installation of the present disclosure, where separate sections of the floating production unit are installed at the offshore location, is far cheaper and simpler and the requirement for heavy and expensive construction vessels is removed, and the elimination of the need for the floating production unit to be continuously manned will ensure lower operating costs.

SUMMARY OF THE DISCLOSURE

According to an example embodiment of the present disclosure there is provided a floating production unit configured to be unmanned during normal production operations, the floating production unit comprising a deck structure for mounting equipment for processing hydrocarbons, and a hull structure. The hull structure comprises a first section formed as a cylindrical like structure, which in turn comprises straight parallel sides, providing the first section with a uniform cross section with a first diameter. The first section has a first ratio of the first diameter divided by a height of the first section. The first section further comprises a deck mounting portion, formed in an upper part of the first section, and to which the deck structure can be attached, a central axis of the first section being substantially perpendicular to a horizontal plane of the deck structure. The hull structure additionally comprises a second section formed as a cylindrical like structure, which in turn comprises straight parallel sides, providing the second section with a uniform cross section with a second diameter, the second diameter being configured to be between 1.1 and 2.5 times that of the first diameter. The second section has a second ratio of the second diameter section divided by a height of the second section, the height of the second section being configured to be between 0.2 and 1.6 times that of the height of the first section. The second section is mounted below the first section and arranged such that a central axis of the second section aligns with the central axis of the first section, wherein the second section is configured when in use to be fully immersed. The hull structure further comprises a plurality of storage cells operable to store ballast when the floating production unit is in use. The hull structure provides a displacement to allow the floating production unit to float when in use, to produce a heave natural period of the floating production unit corresponding to a period above which there is less than 15% of a total wave spectral energy in an extreme wave environment at an offshore location of the floating production unit.

In accordance with this first aspect of the invention, a floating production unit configured to be unmanned during routine production operations according to the present technique can be made as a substantially compact unit which is capable of handling and producing hydrocarbons more cost effectively with a smaller amount of equipment and structure compared to a typical, larger floating production unit. An advantageous effect of this is that this allows for lower productions costs.

A problem with more compact floating production units is their susceptibility to movement induced by waves, leading to relatively large responses to wave forces when compared with larger units. However, a floating production unit according to the present disclosure can provide a compact unit, which has dimensions which can lead to a heave natural period outside an area of significant wave energy, and as a result, it has substantially reduced and improved hydrodynamic responses.

According to another example embodiment of the present disclosure there is provided a method of installing a floating production unit, the method comprising fabricating, launching and towing a hull structure forming part of the floating production unit to an offshore site. The hull structure comprises a first section formed as a cylindrical like structure, which in turn comprises straight parallel sides, providing the first section with a uniform cross section with a first diameter. The first section has a first ratio of the first diameter divided by a height of the first section. The first section further comprises a deck mounting portion, formed in an upper part of the first section, and to which a deck structure, for mounting equipment for processing hydrocarbons, can be attached, a central axis of the first section being substantially perpendicular to a horizontal plane of the deck structure. The hull structure additionally comprises a second section formed as a cylindrical like structure, which in turn comprises straight parallel sides, providing the second section with a second diameter, the second diameter being configured to be between 1.1 and 2.5 times that of the first diameter. The second section has a second ratio of the second diameter divided by a height of the second section, the height of the second section being configured to be between 0.2 and 1.6 times that of the height of the first section. The second section is mounted below the first section and arranged such that a central axis of the second section aligns with the central axis of the first section, wherein the second section is configured when in use to be fully immersed. The hull structure further comprises a plurality of storage cells operable to store ballast when the floating production unit is in use. The hull structure provides a displacement to allow the floating production unit to float when in use, to produce a heave natural period of the floating production unit corresponding to a period above which there is less than 15% of a total wave spectral energy in an extreme wave environment at an offshore location of the floating production unit. The method of installation of the floating production unit further comprises mooring the hull structure to the sea bed, ballasting the hull structure such that the hull structure is at least partially submerged, fabricating, launching and towing the deck structure to the offshore site independently to the hull structure and such that the deck structure is positioned directly above the at least partially submerged hull structure, pulling the at least partially submerged hull structure towards the floating deck structure, connecting the hull structure to the deck structure to construct the floating production unit, and de-ballasting the floating production unit to an operational level.

In accordance with this second aspect of the invention, installation of the floating production unit can be achieved with less difficulty and cost, and allows for the use of smaller and lighter construction equipment and systems. The FPU can be constructed at coastal facilities near to the installation site and towed in more than one part to the offshore site, where it can be installed without needing heavy lifting equipment such as floating cranes. An advantage of such a method of installation is not only that it can be achieved cheaply, but in less developed parts of the world without the complex infrastructure required to build the larger type of floating systems. Ultimately, this allows for the exploration and production of offshore oil fields which without the use of the present invention would not be economically viable.

Various further aspects and features of the present technique are defined in the appended claims, which include a floating production unit and a method of installing the floating production unit.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings wherein like reference numerals designate identical or corresponding parts throughout the several views, and wherein.

DESCRIPTION OF EXAMPLE EMBODIMENTS

Figure 1:
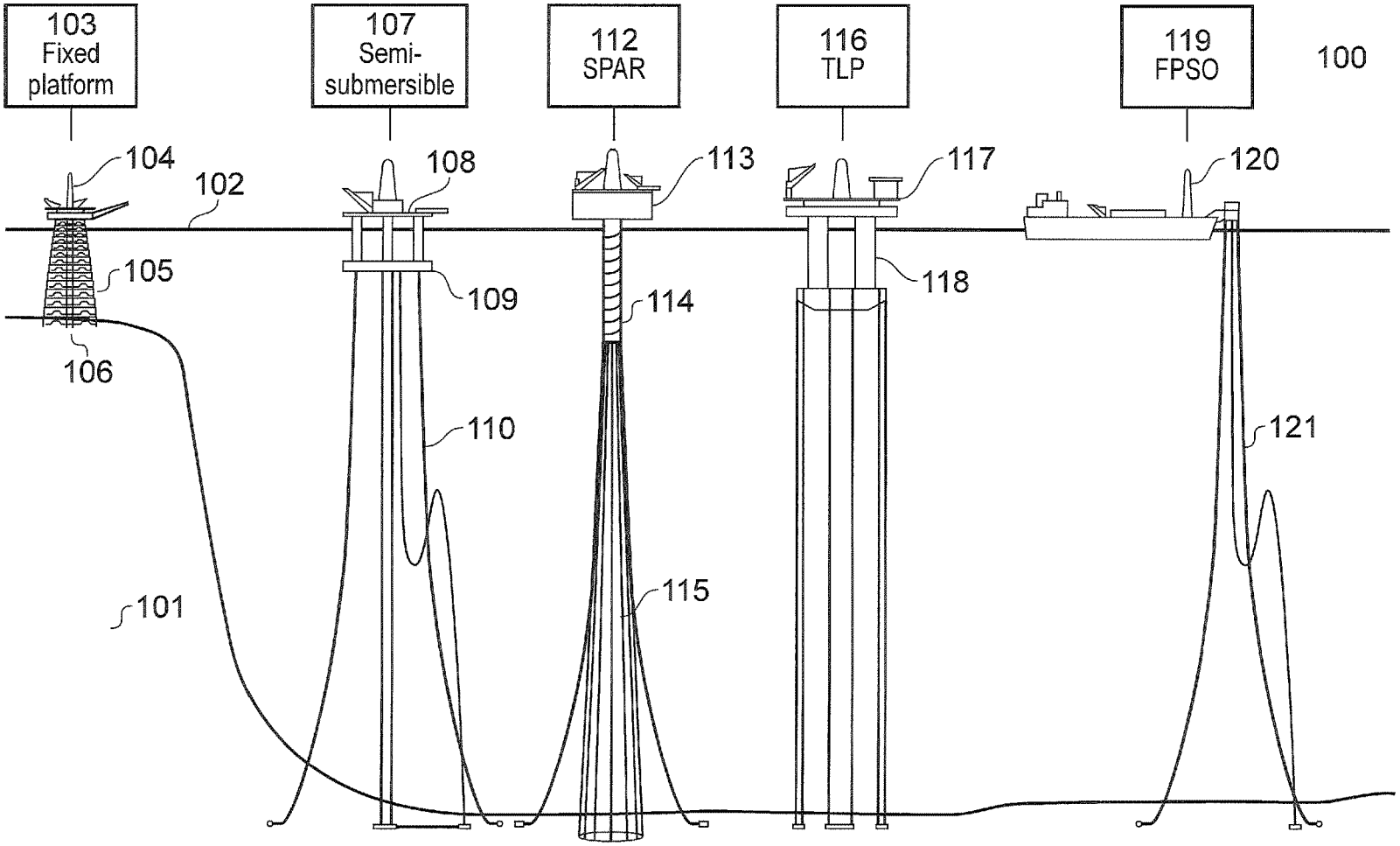
FIG. 1 provides an overview of existing floating production technologies.

Hereinafter preferred embodiments of the present technique will be described in detail with reference to the appended drawings. Note that, in this specification and appended drawings, structural elements that have substantially the same function and structure are denoted with the same reference numerals, and repeated explanation of these structural elements is omitted.

Floating production units are in use in all of the major offshore hydrocarbon producing regions around the world. They provide field development solutions, which can be used in water depths from 30 meters up to 3000 meters, and in a range of different meteorological and oceanographic conditions. FPUs are in operation in all environments from the benign equatorial regions of West Africa, to the harsher Northern latitudes of the North Sea and Atlantic Canada. As exploration activities move into increasingly deep and hostile waters, the FPU will continue to offer oil companies a robust solution for the development of offshore oil and gas resources.

There are three key elements of the basic FPU design. The first of these is the way in which the mass is distributed and the buoyancy is arranged to support the deck carrying production equipment. The distribution of mass and the configuration of buoyancy elements have a major impact on the stability of the unit and the way in which the motion of the vessel varies in response to waves. The second element is the way the vessel is held in position, in terms of its mooring and position keeping. Thirdly, it is important to consider the way in which the structure is to be assembled at both the construction site, and then at the offshore field location.

There are numerous different FPU technologies, which vary in terms of the key elements described above. FIG. 1 presents an overview of some of these technologies, as well as a conventional fixed platform.

A fixed platform 103 is built on solid legs 105 made up of materials such as concrete or steel which are anchored directly into the sea bed 101, fixing the platform 103 securely into place. The platforms comprise a deck structure 104 which is above sea level 102, and resting on top of the legs 105. The deck structure 104 houses equipment for drilling and processing hydrocarbons, as well as accommodation facilities for workers. Such a platform 103 is structurally sound and ideal for the development of fields located in relatively shallow parts of the sea 106, but not economically or technically viable for fields located deep below the water's surface 111. It is in such cases where FPUs are considered to be a better technical and economic option.

One such type of FPU is a semi-submersible platform 107. Semi-submersibles 107 consist of a deck structure 108 for housing the necessary equipment for drilling and processing hydrocarbons, and for housing crew quarters, which is connected by structural columns to a number of watertight ballasted pontoons 109. These pontoons 109 are submerged at a deep draft, supplying the semi-submersible 107 with buoyancy, and are anchored to the sea bed 101 using moorings 110 formed typically by a combination of chain, wire or polyester rope usually referred to as a catenary mooring system.

A spar platform 112 is another commonly used FPU technology. A deck structure 113 used for housing the crew and the hydrocarbon drilling and processing equipment sits on top of a long cylindrical hull structure 114, to provide buoyancy to the platform 112 which is more heavily weighted with a ballasting material at the bottom to provide ballast to the platform 112 and lower the overall vertical centre of gravity. Again this is moored in place to the sea bed 101 using a catenary mooring system with a combination of chain, wire or polyester rope 115.

Tension leg platforms 116 are moored by groups of tethers at each of the corners of the structure 118, which are referred to as the tension legs. These are very inelastic structures which almost fully eliminate vertical movement, which in turn allows for a simpler, rigid production riser design. The deck structure 117 sits on top of the platform, and houses all necessary equipment for oil and natural gas production.

Floating production, storage and offloading units 119, or FPSOs, are vessels 120 which generally float near the water's surface. These can be converted oil tankers or specifically designed vessels, and can be moored 121 to the sea bed while they develop oil or natural gas fields.

Figure 2:
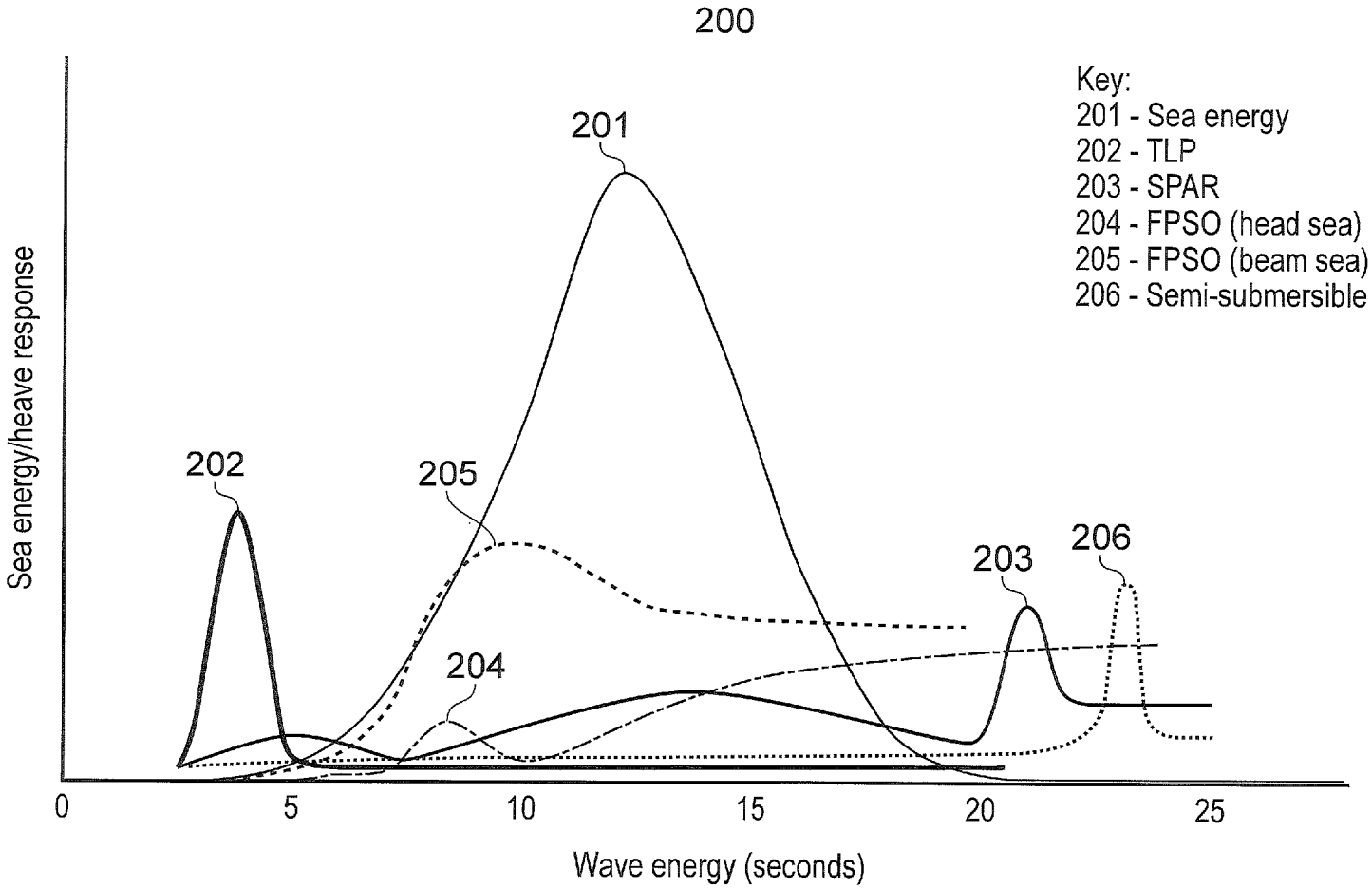
FIG. 2 displays the heave response characteristics for different floating production technologies.

FIG. 2 illustrates the heave response—the amount of vertical movement in response to waves—for each of these FPU technologies plotted against wave energy. Also plotted on the graph is the sea energy 201. The heave response of tension leg platforms 202 is shown to be generally below 5 seconds. As described above, it is the inelastic tension legs which ensure that the heave natural period of tension leg platforms is below the area of significant wave energy. The heave response of semi-submersible platforms 206 is substantially above the area of significant wave energy, with a heave response generally above 20 seconds.

The heave response of FPSOs 204, 205 is within the area of significant wave energy, showing that FPSOs are susceptible to significant vertical movement in higher sea states. Spar platforms have a heave response 203 similar to that of semi-submersibles.

According to an arrangement of the present disclosure, there is provided a floating production unit configured to be unmanned during normal production operations and a method of installing the floating production unit. The floating production unit is configured to be relatively compact and able to be constructed at coastal facilities without the necessity for heavy lift cranes and other expensive facilities. The floating production unit is further configured to be installed at the offshore site using a technique exploiting ballasting and buoyancy without the necessity for heavy lift floating cranes.

The design of an FPU involves a complex interaction between a number of interdependent design parameters including equipment selection and layout, space and weight considerations, safety, hydrodynamics, stability and structural engineering, resulting in considerable system uncertainty to deliver the required design objectives without compromising other countervailing design parameters. Embodiments of the present disclosure address a number of key areas of uncertainty.

The first key area of uncertainty addressed by the present disclosure is in achieving a balance between hydrodynamic responses—particularly heave, whilst at the same time achieving sufficient stability to carry the required production equipment and utilities. This has required a particularly novel approach to the distribution of the buoyancy and centre of gravity for the structure and an innovative use of ballast and hull geometry which can be used to mobilise additional damping to attenuate vessel motions.

The second key area of uncertainty addressed by the present disclosure is to design the structure in two parts such that the hull structure could be towed to site and pre-installed, together with unit moorings, risers and umbilical cables, and the deck structure can be towed to site and connected to the hull part using buoyancy and ballasting operations alone, without the requirement for heavy lift vessels. Both the hull and deck structures may be loaded out with quayside cranes, or by slipway/ship-lift, and float at a draught of less than 5 meters; this avoids being restricted to a limited number of construction sites and opens up the possibility of construction at in-country fabrication facilities in less industrialised countries in order to increase local content.

The third key area of uncertainty addressed by the present disclosure is to effectively integrate and combine certain compact process technologies, such as those technologies designed for subsea and/or in well-bore processing for production use on the unit. Such technologies, whilst potentially more expensive at an equipment level, offer the benefit of low weight, small size, low maintenance, and remote operation, all of which allow the development of a small, lightweight topsides suitable for not normally manned operations.

Embodiments of the present disclosure address at least four objectives. The first of these is process intensification, and focusses on integrating compact process technologies to deliver higher production throughput with smaller and lighter process equipment and utilities.

The second objective is that of developing a compact floating facility structure. The smaller the structure, the lower the cost, but several factors must be taken into account to do so. Supporting and providing a stable platform for the process equipment is one of these, as is being able to withstand site specific meteorological and oceanographic loads for areas such as the North Sea. In addition to this, it is necessary for a structure to be arranged which delivers acceptable motions and accelerations, in terms of process performance, riser performance, mooring loads and human factors.

The third objective is easy installation. A structure has been developed which can be both constructed and installed cost effectively without the use of expensive construction vessels such as heavy lift cranes, and which can be constructed at coastal facilities near to the installation site.

The final objective is that of low cost operations. The use of remote control technologies, used on not normally manned fixed facilities, and high reliability, low maintenance process and utilities, allow prolonged periods of not normally manned operations. Embodiments of the present disclosure may provide floating production units which are designed and configured such that they are not manned during routine production operations, thus delivering low operating costs. Access and egress of maintenance teams may be by helicopter in harsh environments. Alternatively, access and egress of maintenance teams may be by boat in benign waters.

An example operating scenario for the use of the present disclosure may be for a field containing mainly oil with minimal amounts of natural gas, and therefore possessing a low gas-to-oil ratio (GOR), and used in conjunction with a floating storage and offloading unit. Oil and gas are separated from produced water, which is processed to meet the required oil in water amount (typically less than 30 ppm) and disposed of overboard. Oil is pumped to a nearby Floating Storage and Offloading unit (FSO), usually a converted oil tanker, for storage and subsequent offloading by another tanker. Associated gas from the well stream fluids is separated from the oil, and used as fuel for power generation, with any excess gas being flared. Power may be used to drive water injection pumps and/or artificial lift pumps, which may be down-hole electrical submersible pumps ESPs, or mud line booster pumps.

An additional example operating scenario for the use of the present disclosure may be for a field containing mainly gas with a minimal amount of liquids, with the floating production unit connected to a gas export pipeline. In this scenario the well stream fluids are predominantly gas with minimal hydrocarbon liquids which may be, for example, minimum amounts of condensate. Gas is dehydrated and compressed for export by pipeline, and gas and condensate are used as a rich gas fuel with a maximum consumption of condensate for power generation. This generated power is then used, for example, to drive gas compression. Any produced water is processed to meet the required oil in water amount (typically less than 30 ppm) and disposed of overboard. For higher levels of condensate production, an FSO may be required or justified.

A further example operating scenario for the use of the present disclosure may be for a field containing oil with a significant percentage of gas, having a medium-to-high GOR, and used in conjunction with an FSO and linked to a gas export pipeline. This scenario combines the facilities used in the above described first and second scenarios, and consequently requires more processing equipment and space than either. It is therefore a somewhat larger unit than that required for either of the above described scenarios.

In any of the above described scenarios, the FSO may be replaced by an adjacent FPSO or other host facility, which has the capacity to receive and/or store processed or part-processed fluids.

A yet further example operating scenario for the use of the present disclosure may be for a field with subsea processing equipment which requires power and control, which can be delivered from the unit, which can be located at the field in the general vicinity of the subsea wells and processing facilities.

Figure 3:
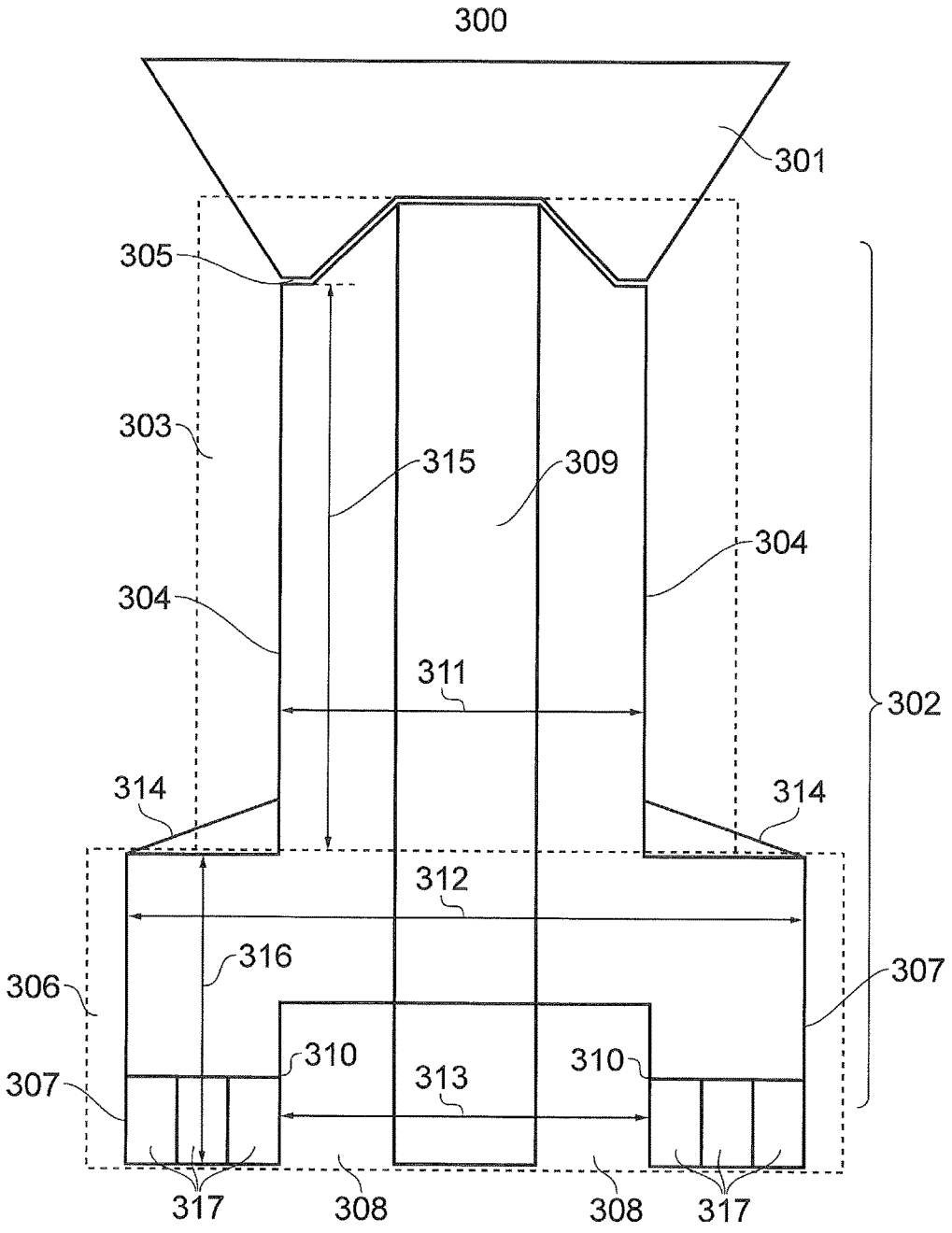
FIG. 3 provides a cross-sectional diagram of a floating production unit in accordance with the present disclosure.

FIG. 3 illustrates a floating production unit 300 in accordance with an arrangement of the present disclosure. The floating production unit 300 is configured to be not normally manned when in use, and comprises a deck structure 301 for mounting equipment for processing hydrocarbons, and a hull structure 302. The hull structure 302 comprises a first section 303 formed as a cylindrical like structure, which in turn comprises straight parallel sides 304, providing the first section 303 with a uniform cross section with a first diameter 311. The first section 303 has a first ratio of the first diameter 311 divided by a height 315 of the first section 303. The first section 303 further comprises a deck mounting portion 305, formed in an upper part of the first section 303, and to which the deck structure 301 can be attached, a central axis of the first section 303 being substantially perpendicular to a horizontal plane of the deck structure 301. The hull structure 302 additionally comprises a second section 306 formed as a cylindrical like structure, which in turn comprises straight parallel sides 307, providing the second section 306 with a uniform cross section with a second diameter 312, the second diameter being configured to be between 1.1 and 2.5 times that of the first diameter. The second section 306 has a second ratio of the second diameter 312 divided by a height 316 of the second section 306, the height of the second section being configured to be between 0.2 and 1.6 times that of the height of the first section. The second section 306 is mounted below the first section 304 and arranged such that a central axis of the second section 306 aligns with the central axis of the first section 304, wherein the second section 306 is configured when in use to be fully immersed. The hull structure further comprises a plurality of storage cells 317 operable to store ballast when the floating production unit is in use. The hull structure 302 provides a displacement to allow the floating production unit 300 to float when in use, to produce a heave natural period of the floating production unit 300 is outside an area of significant wave energy.

The relative dimensions and immersed volumes of the first section 303 and the second section 306 of the hull structure 302 are configured such that the heave natural period of the unit 300 corresponds to a period above which there is less than 15% of the total wave spectral energy in the extreme wave environment (i.e. above the area of significant wave energy) at the desired installed location, thus creating vessel motions which are tolerable despite the unit's compact size.

The cross section of the first section 303 may be circular, oval or polygonal in shape. The cross section of the second section may also be circular, oval or polygonal in shape.

Embodiments of the present disclosure may provide the second section 306 with an inclined top section 314.

The second section 306 may additionally include an air skirt 308, for providing a recess in a lower part of the second section 306. This may be used adjusting the buoyancy of the hull structure 302 of the floating production unit 300 during float-out and installation. The recess has straight parallel sides 310 substantially parallel to the sides 307 of the second section 306. These straight parallel sides 310 provide the recess with a uniform cross section, with a third diameter 313, and the second diameter being greater than the third diameter.

The floating production unit 300 further comprises a central access tube 309, which may extend as shown in FIG. 3 or may terminate at a higher level. The central access tube provides a conduit for risers and umbilicals connecting the processing facilities on the deck structure 301 to one or more subsea wells. The central access tube 309 in turn comprises a plurality of I-tubes, which are used to encase and protect production risers and umbilicals against damage from wave forces.

The ballast which may be stored in the plurality of storage cells when the floating production unit is in use is configured to lower the centre of gravity of the floating production unit which, when combined with the geometry of the floating production unit, allows the floating production to be both stable and hydrodynamically efficient. The ballast may comprise salt water and/or high-density pumpable ballast with a specific gravity of 2 or more. Although in FIG. 3 there are six storage cells 317 which are contained at the bottom of the second section 306 of the hull structure 302, embodiments of the present disclosure may provide floating production units with more or fewer than six storage cells 317, and the storage cells 317 may be provided at a different location within the hull structure 302.

The equipment for processing hydrocarbons which may be mounted on the deck structure 301 may comprise equipment which is specified and configured for unmanned operations. The floating production unit is configured to be un-manned during routine production operations, but may be manned for less frequent activities such as maintenance, repair or installation.

The floating production unit 300 may comprise a mooring system to keep the unit in the desired location, mooring the hull structure 501 to the sea bed. This may be performed by a taught or a semi-taught mooring system 510 comprising a chain ground section, a synthetic rope mid-section and an upper chain section. Alternatively, the ground section and/or upper section may comprise wire.

The floating production unit 300 may further comprise pumps and one or more risers for pumping processed hydrocarbons to a remote floating storage and offloading unit.

Figure 4:
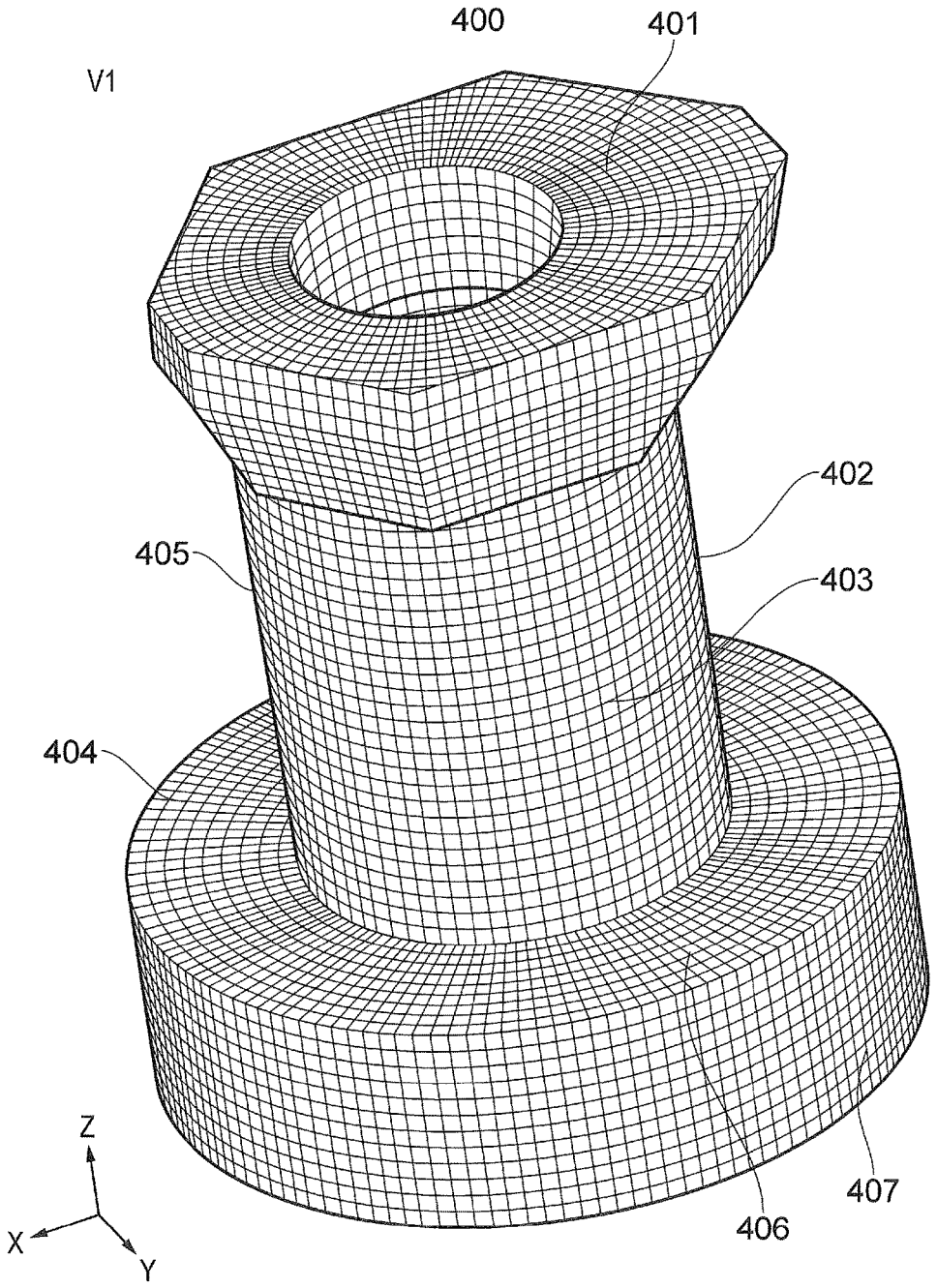
FIG. 4 provides a three-dimensional diagram of a floating production unit in accordance with the present disclosure.

FIG. 4 illustrates a floating production unit 400 in accordance with an arrangement of the present disclosure. The floating production unit 400 comprises a deck structure 401 for mounting equipment for processing hydrocarbons, and a hull structure 402. The hull structure 402 comprises a first section 403 formed as a cylindrical like structure, which in turn comprises straight parallel sides 404, providing the first section 403 with a uniform cross section with a first diameter. The first section 403 has a first ratio of the first diameter divided by a height of the first section 403. The first section 403 further comprises a deck mounting portion 405, formed in an upper part of the first section 403, and to which the deck structure 401 can be attached, a central axis of the first section 403 being substantially perpendicular to a horizontal plane of the deck structure 401. The hull structure 402 additionally comprises a second section 406 formed as a cylindrical like structure, which in turn comprises straight parallel sides 407, providing the second section 406 with a uniform cross section with a second diameter, the second diameter being configured to be between 1.1 and 2.5 times that of the first diameter. The second section 406 has a second ratio of the second diameter divided by a height of the second section 406, the height of the second section being configured to be between 0.2 and 1.6 times that of the height of the first section. The second section 406 is mounted below the first section 403 and arranged such that a central axis of the second section 406 aligns with the central axis of the first section 403, wherein the second section 406 is configured when in use to be fully immersed. The hull structure further comprises a plurality of storage cells operable to store ballast when the floating production unit is in use.

The cross section of the first section 403 may be circular, oval or polygonal in shape. The cross section of the second section 406 may also be circular, oval or polygonal in shape.

FIGS. 5*a* through to 5*h* demonstrates a method 500 of installing a floating production unit, according to the present technique. The method 500 comprises, as shown in FIG. 5*a*, fabricating, launching and towing a hull structure 501 forming part of the floating production unit to an offshore site. The towing may be accomplished using one or more tugs or anchor handlers 502, 503. The launching and the towing of the hull structure 501 may further comprise using a subdivided air cushion buoyancy. The hull structure 501 comprises a first section 504 formed as a cylindrical like structure, which in turn comprises straight parallel sides 505, providing the first section 504 with a uniform cross section with a first diameter. The first section 504 has a first ratio of the first diameter divided by a height of the first section 504. The first section 504 further comprises a deck mounting portion 506, formed in an upper part of the first section 504, and to which a deck structure 507, for mounting equipment for processing hydrocarbons, can be attached, a central axis of the first section 504 being substantially perpendicular to a horizontal plane of the deck structure 507. The hull structure 501 additionally comprises a second section 508 formed as a cylindrical like structure, which in turn comprises straight parallel sides 509, providing the second section 508 with a uniform cross section with a second diameter, the second diameter being configured to be between 1.1 and 2.5 times that of the first diameter. The second section 508 has a second ratio of the second diameter divided by a height of the second section 508 the height of the second section being configured to be between 0.2 and 1.6 times that of the height of the first section. The second section 508 is mounted below the first section 504 and arranged such that a central axis of the second section 508 aligns with the central axis of the first section 504, wherein the second section 508 is configured when in use to be fully immersed. The hull structure further comprises a plurality of storage cells operable to store ballast when the floating production unit is in use in order to lower the overall centre of gravity of the unit and maximise the amount of topsides equipment that can be installed on the compact floating production unit, whilst still remaining stable. Ballast may be in the form of salt water and/or high-density pumpable ballast, which may have a specific gravity of 2 or more. The combination of the geometry of the hull structure and the distribution of this salt water and/or high density pumpable ballast allows a hydrodynamically efficient but inherently unstable floating production unit to be rendered stable, both during installation and in operation.

The method of installation 500 of the floating production unit further comprises, as demonstrated in FIG. 5*b*, mooring the hull structure 501 to the sea bed. This may be performed by a taught or a semi-taught mooring system 510 comprising a chain ground section, a synthetic rope mid-section and an upper chain section. Alternatively, the ground section and/or upper section may comprise wire. Alternatively, this may be performed by a different mooring system, such as a catenary mooring system.

The method of installation 500 of the floating production unit further comprises, as demonstrated in FIG. 5*c*, installing a plurality of flexible flow-line production risers and umbilical cables 511 to connect the floating production unit to one or more subsea wells. Alternatively, other riser technologies may be used.

The method of installation 500 of the floating production unit further comprises, as demonstrated in FIG. 5*d*, ballasting the hull structure 501 such that the hull structure 501 is at least partially submerged. The hull structure 501 may be fully submerged. This may be achieved through the use of salt water and/or high-density pumpable ballast, which may have a specific gravity of 2 or more, to lower the centre of gravity of the unit both during installation and in operation. The ballast may be stored within a plurality of tanks or storage cells located within the hull structure.

The method of installation 500 of the floating production unit further comprises, as demonstrated in FIG. 5*e*, fabricating, launching and towing the deck structure 507 to the offshore site independently to the hull structure 501 and such that the deck structure 507 is positioned directly above the at least partially submerged hull structure 501.

The method of installation 500 of the floating production unit further comprises, as demonstrated in FIG. 5*f*, pulling the at least partially submerged hull structure 501 towards the floating deck structure 507. This may be achieved using one or more winches 512.

The method of installation 500 of the floating production unit further comprises, as demonstrated in FIG. 5*g*, connecting the hull structure 501 to the deck structure 507 to construct the floating production unit.

The method of installation 500 of the floating production unit further comprises, as demonstrated in FIG. 5*h*, deballasting the floating production unit to an operational level.

Figure 5:
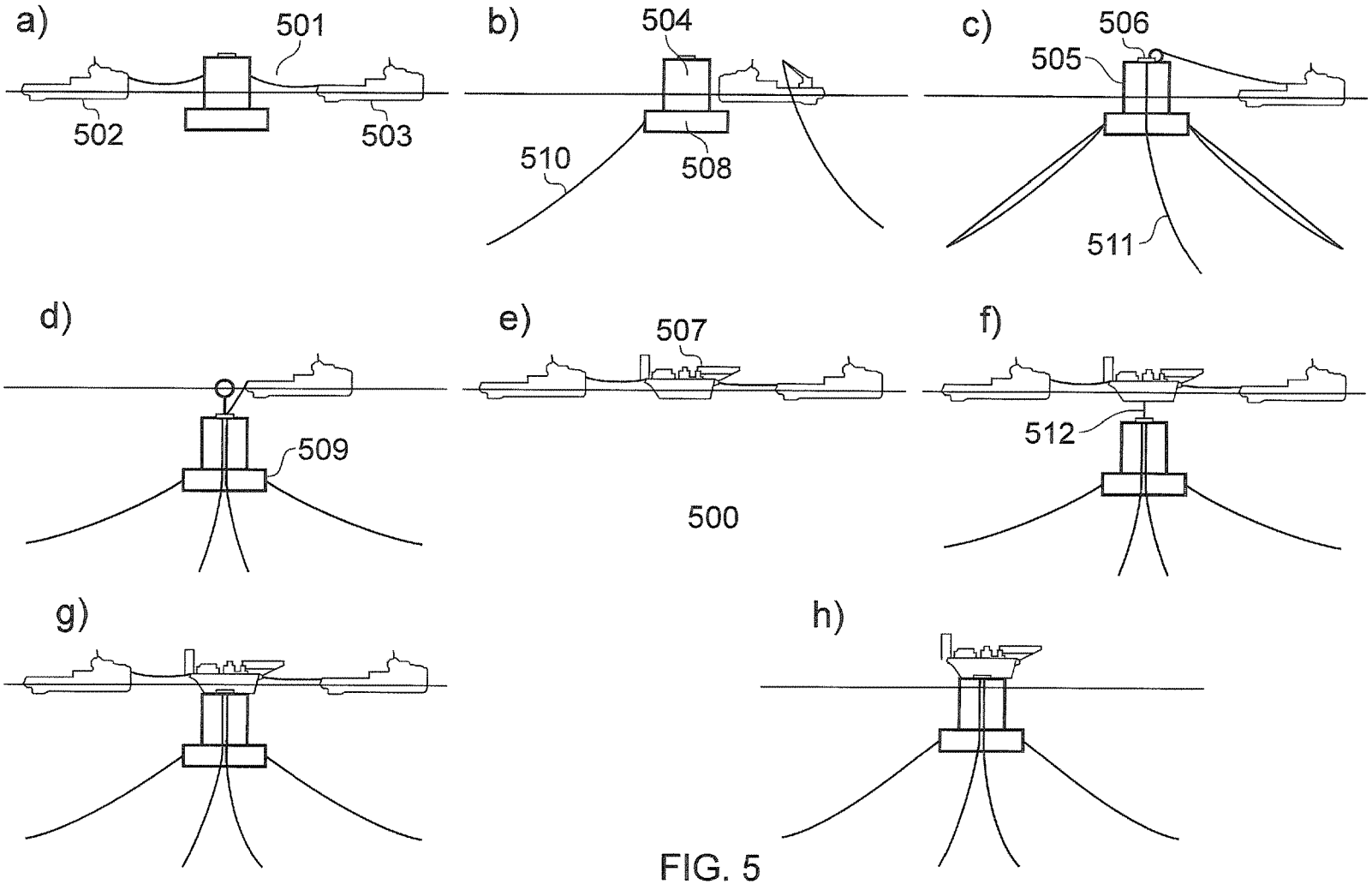
FIG. 5*a* illustrates a method of towing a hull structure of a floating production unit to an offshore location in accordance with the present technique.
FIG. 5*b* illustrates a method of securing a hull structure of a floating production unit to the seabed at an offshore location in accordance with the present technique.
FIG. 5*c* illustrates a method of installing one or more production risers and umbilicals to connect a floating production unit to one or more subsea wells in accordance with the present technique.
FIG. 5*d* illustrates a method of ballasting a hull structure of a floating production unit to an at least partially submerged level in accordance with the present technique.
FIG. 5*e* illustrates a method of towing a deck structure of a floating production unit to an offshore location in accordance with the present technique.
FIG. 5*f* illustrates a method of pulling a hull structure of a floating production unit towards a deck structure of the floating production unit in accordance with the present technique.
FIG. 5*g* illustrates a method of securing a hull structure of a floating production unit to a deck structure of the floating production unit in accordance with the present technique.
FIG. 5*h* illustrates a method of de-ballasting a floating production unit to an operational level in accordance with the present technique.

Example embodiments of the present disclosure are configured to satisfy the following parameters:

Having regard to FIGS. 3 to 5, an immersed volume of the second section is configured to be between 0.2 and 3.5 times that of the immersed volume of the first section.

Having regard to FIGS. 3 to 5, the first ratio is configured to be between 0.2 and 2.5.

Having regard to FIGS. 3 to 5, the second ratio is configured to be between 1.0 and 8.0.

Having regard to FIGS. 3 to 5, the floating production unit hull and deck structures are configured to have a draught of no more than 5 meters when loaded out and in transit to the field.

Having regard to FIGS. 2 to 5, a heave response of the floating production unit is configured to be above 15 seconds when in use.

The wave frequency heave, roll and pitch displacements and accelerations are configured to be beneficial to the performance of the production unit in terms of production equipment performance, mooring and riser performance and in terms of reduced wave frequency loads, helicopter and boat operations and human factors performance.

Figure 6:
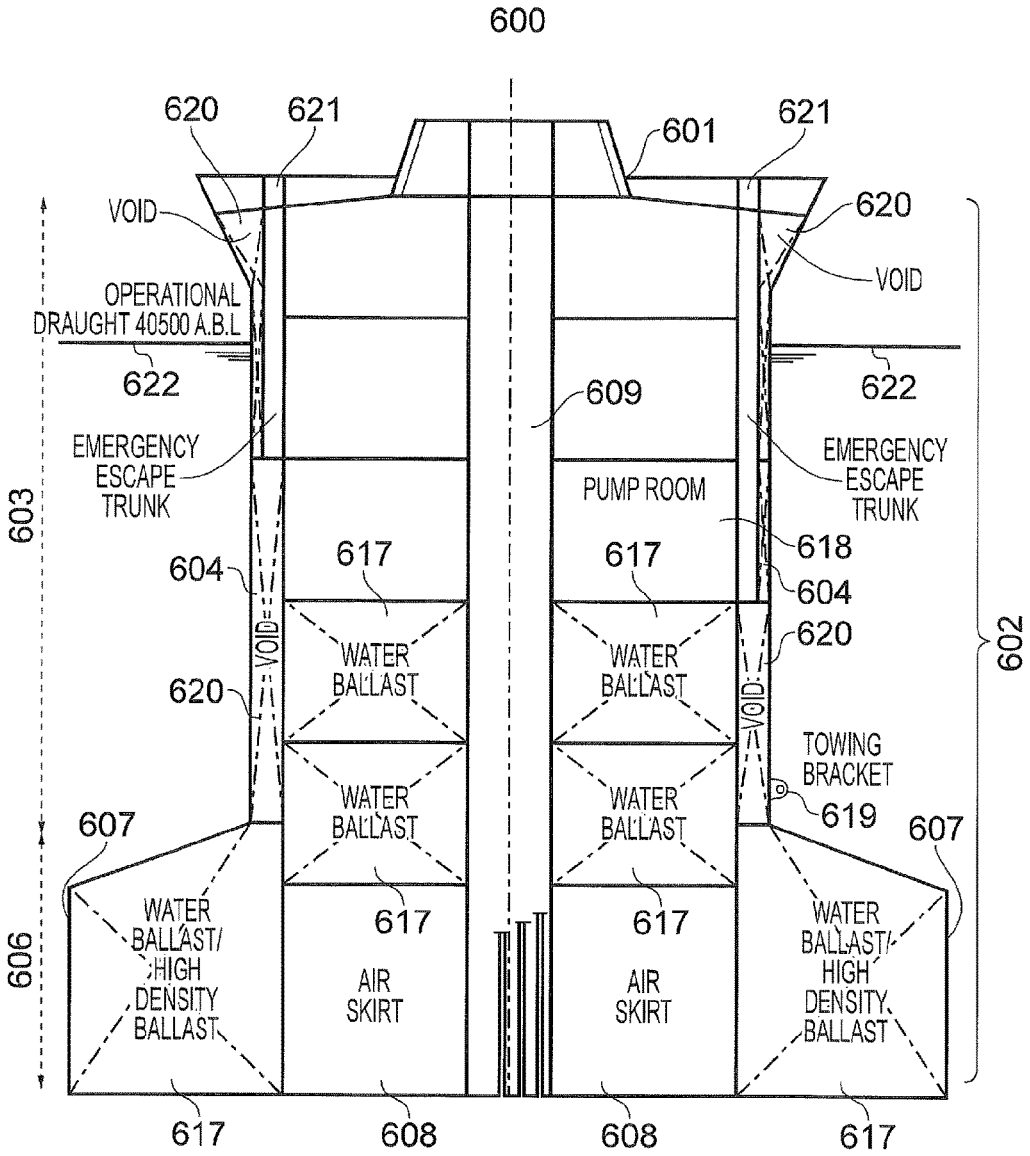
FIG. 6 provides a cross-sectional diagram of a floating production unit in accordance with embodiments of the present disclosure.

FIG. 6 illustrates a floating production unit 600 in accordance with an arrangement of the present disclosure. The floating production unit 600 is configured to be not normally manned when in use, and comprises a deck structure 601 for mounting equipment for processing hydrocarbons, and a hull structure 602. The hull structure 602 comprises a first section 603 formed as a cylindrical like structure, which in turn comprises straight parallel sides 604, providing the first section 603 with a uniform cross section with a first diameter. The first section 603 has a first ratio of the first diameter divided by a height of the first section 603. The first section 603 further comprises a deck mounting portion, formed in an upper part of the first section 603, and to which the deck structure 601 can be attached, a central axis of the first section 603 being substantially perpendicular to a horizontal plane of the deck structure 601. The hull structure 602 additionally comprises a second section 606 formed as a cylindrical like structure, which in turn comprises straight parallel sides 607, providing the second section 606 with a uniform cross section with a second diameter, the second diameter being configured to be between 1.1 and 2.5 times that of the first diameter. The second section 606 has a second ratio of the second diameter divided by a height of the second section 606, the height of the second section being configured to be between 0.2 and 1.6 times that of the height of the first section. The second section 606 is mounted below the first section 604 and arranged such that a central axis of the second section 606 aligns with the central axis of the first section 604, wherein the second section 606 is configured when in use to be fully immersed. The hull structure further comprises a plurality of storage cells 617 operable to store ballast when the floating production unit is in use.

Although in FIG. 6 there are six storage cells or regions 617 which are contained in the second section 606 of the hull structure 602 and the bottom of the first section 603 of the hull structure 602, embodiments of the present disclosure may provide floating production units with more or fewer than six storage cells 617, and the storage cells 617 may be provided at different or various locations within the hull structure 602.

The second section 606 may additionally include an air skirt 608, for providing a recess in a lower part of the second section 606. This may be used adjusting the buoyancy of the hull structure 602 of the floating production unit 600 during float-out and installation. The recess has straight parallel sides substantially parallel to the sides 607 of the second section 606. These straight parallel sides provide the recess with a uniform cross section, with a third diameter, and the second diameter being greater than the third diameter.

The floating production unit 600 further comprises a central access tube 609, which may extend as shown in FIG. 6 or may terminate at a higher or lower level. The central access tube provides a conduit for risers and umbilicals connecting the processing facilities on the deck structure 601 to one or more subsea wells. The central access tube 609 in turn comprises a plurality of I-tubes, which are used to encase and protect production risers and umbilicals against damage from wave forces.

The floating production unit 600 is configured to be towed to an offshore location by one or more tugs or anchor handlers using a towing bracket 619 positioned on a side of the hull structure 602 and, when in use, to have an operational draught 622 wherein only the deck structure 601 and the top of the first section 603 of the hull structure 602 are above the surface of the water. The floating production unit 600 also comprises a pumproom 618 for housing comprise pumps and one or more risers for pumping processed hydrocarbons to a remote floating storage and offloading unit. The floating production unit 600 may further comprise one or more voids 620 and one or more emergency escape trunks 621 for allowing engineers or technicians on board the floating production unit 600 for non-routine operations such as maintenance, repair or installation to safely and quickly evacuate the floating production unit 600 during emergencies.

Various further aspects and features of the present technique are defined in the appended claims. Various modifications may be made to the embodiments hereinbefore described within the scope of the appended claims. For example, although flexible flow-line production risers have been presented as an example appendage, it will be appreciated that other riser technologies may be used in conjunction with the claimed floating production unit.

The following numbered paragraphs provide further example aspects and features of the present technique:

Paragraph 1. A floating production unit comprising:

a deck structure for mounting equipment for processing hydrocarbons; and a hull structure comprising:

a first section formed as a cylindrical like structure comprising straight parallel sides providing the first section with a uniform cross section with a first diameter, the first section having a first ratio of the first diameter divided by a height of the first section, and a deck mounting portion formed in an upper part of the first section to which the deck structure can be attached, a central axis of the first section being substantially perpendicular to a horizontal plane of the deck structure;

a second section formed as a cylindrical like structure comprising straight parallel sides providing the second section with a uniform cross section with a second diameter, the second diameter being configured to be between 1.1 and 2.5 times that of the first diameter, the second section having a second ratio of the second diameter divided by a height of the second section, the height of the second section being configured to be between 0.2 and 1.6 times that of the height of the first section, the second section being mounted below the first section and arranged such that a central axis of the second section aligns with the central axis of the first section, wherein the second section is configured when in use to be fully immersed; and a plurality of storage cells operable to store ballast when the floating production unit is in use, the hull structure providing a displacement to allow the floating production unit to float when in use, to produce a heave natural period of the floating production unit corresponding to a period above which there is less than 15% of a total wave spectral energy in an extreme wave environment at an offshore location of the floating production unit.

Paragraph 2. A floating production unit according to Paragraph 1, wherein an immersed volume of the second section is configured to be between 0.2 and 3.5 times that of the immersed volume of the first section.

Paragraph 3. A floating production unit according to Paragraph 1, wherein the first ratio is configured to be between 0.2 and 2.5.

Paragraph 4. A floating production unit according to Paragraph 1 or 2, wherein the second ratio is configured to be between 1.0 and 8.0.

Paragraph 5. A floating production unit according to Paragraph 1, 2 or 3, wherein the ballast may comprise salt water and/or high-density pumpable ballast with a specific gravity of 2 or more.

Paragraph 6. A floating production unit according to any of Paragraphs 1 to 5, wherein the floating production unit further comprises a central access tube providing a conduit for risers and umbilicals between the production equipment on the deck structure and one or more subsea wells.

Paragraph 7. A floating production unit according to any of Paragraphs 1 to 6, wherein the central access tube comprises a plurality of I-tubes.

Paragraph 8. A floating production unit according to any of Paragraphs 1 to 7, wherein the second section includes an air skirt for providing a recess in a lower part of the second section for adjusting the buoyancy of the floating production unit, the recess having straight parallel sides substantially parallel to the sides of the second section and providing the recess with a uniform cross section with a third diameter, the second diameter being greater than the third diameter.

Paragraph 9. A floating production unit according to any of Paragraphs 1 to 8, further comprising pump and/or compressors and one or more risers for exporting processed hydrocarbons.

Paragraph 10. A floating production unit according to any of Paragraphs 1 to 9, wherein a draught of the hull structure and the deck structure of the floating production unit is configured to be no more than 5 meters at launch at their construction sites.

Paragraph 11. A floating production unit according to any of Paragraphs 1 to 10, wherein a heave response of the floating production unit is configured to be above 15 seconds when in use.

Paragraph 12. A floating production unit according to any of Paragraphs 1 to 11, wherein the cross section of the first section and/or the cross section of the second section is substantially circular.

Paragraph 13. A floating production unit according to any of Paragraphs 1 to 12, wherein the cross section of the first section and/or the cross section of the second section is substantially oval.

Paragraph 14. A floating production unit according to any of Paragraphs 1 to 13, wherein the cross section of the first section and/or the cross section of the second section is substantially polygonal.

Paragraph 15. A method of installing a floating production unit, the method comprising:

fabricating, launching and towing a hull structure forming part of the floating production unit to an offshore site, the hull structure comprising:

a first section formed as a cylindrical like structure comprising straight parallel sides providing the first section with a uniform cross section with a first diameter, the first section having a first ratio of the first diameter divided by a height of the first section, and a deck mounting portion formed in an upper part of the first section to which a deck structure for mounting equipment for processing hydrocarbons can be attached, a central axis of the first section being substantially perpendicular to a horizontal plane of the deck structure;

a second section formed as a cylindrical like structure comprising straight parallel sides providing the second section with a uniform cross section with a second diameter, the second diameter being configured to be between 1.1 and 2.5 times that of the first diameter, the second section having a second ratio of the second diameter divided by a height of the second section the height of the second section being configured to be between 0.2 and 1.6 times that of the height of the first section, the second section being mounted below the first section and arranged such that a central axis of the second section aligns with the central axis of the first section, wherein the second section is configured when in use to be fully immersed; and a plurality of storage cells operable to store ballast when the floating production unit is in use, the hull structure providing a displacement to allow the floating production unit to float when in use, to produce a heave natural period of the floating production unit corresponding to a period above which there is less than 15% of a total wave spectral energy in an extreme wave environment at the offshore site of the floating production unit;

mooring the hull structure to the sea bed;

ballasting the hull structure such that the hull structure is at least partially submerged;

fabricating, launching and towing a deck structure forming part of the floating production unit to the offshore site independently to the hull structure and such that the deck structure is positioned directly above the at least partially submerged hull structure;

pulling the at least partially submerged hull structure towards the floating deck structure;

connecting the hull structure to the deck structure to construct the floating production unit; and de-ballasting the floating production unit to an operational level.

Paragraph 16. A method according to Paragraph 15, wherein the launching and towing the hull structure further comprises using a sub-divided air cushion for buoyancy.

Paragraph 17. A method according to Paragraph 15 or 16, wherein the mooring the hull structure to the sea bed is performed by either a catenary mooring system, a semi-taught mooring system or a taught mooring system comprising a combination of a ground chain or wire section, a synthetic rope or wire mid-section and an upper chain or wire section.

Paragraph 18. A method according to Paragraph 15, 16 or 17, wherein subsequent to the mooring the hull structure to the sea bed, the method further comprising installing a plurality of flexible flow-line risers and umbilical cables to connect the floating production unit to one or more subsea wells.

Paragraph 19. A method according to any of Paragraphs 15 to 18, wherein the ballasting the hull structure further comprises using high-density pumpable ballast.

Paragraph 20. A method according to any of Paragraphs 15 to 19, wherein the pulling the at least partially submerged hull structure towards the floating deck structure comprises using one or more winches.

REFERENCES

[1] Offshore Technology. *The Dominance of FPSO.* 29 Aug. 2008. http//www.offshore-technology.com/features/feature40937/ (accessed 19 Feb. 2015).

RELATED ART

EP 0256177 A1—Spar buoy construction having production and oil storage facilities and method of operation U.S. Pat. No. 6,336,421 B1—Floating spar for supporting production risers U.S. Pat. No. 6,092,483 A—Spar with improved VIV performance U.S. Pat. No. 4,606,673 A—Spar buoy construction having production and oil storage facilities and method of operation EP 0256177 A1—Spar buoy construction having production and oil storage facilities and method of operation EP 0256177 A1—Spar buoy construction having production and oil storage facilities and method of operation U.S. Pat. No. 6,263,824 B1—Spar platform U.S. Pat. No. 5,706,897 A—Drilling, production, test, and oil storage caisson U.S. Pat. No. 8,544,402 B2—Offshore buoyant drilling, production, storage and offloading structure WO 2013/022484 A1—Stable offshore floating depot U.S. Pat. No. 7,958,835 B2—Offshore floating production, storage, and off-loading vessel for use in ice-covered and clear water applications U.S. Pat. No. 6,761,508 B1—Satellite separator platform (SSP)

WO 2014/108432 A1—Floating unit and a method for reducing heave and pitch/roll motions of a floating unit U.S. Pat. No. 8,544,404 B2—Mono-column FPSO U.S. Pat. No. 6,945,736 B2—Offshore platform for drilling after or production of hydrocarbons CA 2723410 A1—Floating platform and method for operation thereof WO 2008/115068 A1—Floating platform for operation in regions exposed to extreme weather conditions WO 2004/080791 A1—A tank installation for the storage of liquids U.S. Pat. No. 6,155,193 A—Vessel for use in the production and/or storage of hydrocarbons WO 2012/104309 A2—Production unit for use with dry Christmas trees U.S. Pat. No. 3,572,041 A—Spar type floating production facility U.S. Pat. No. 8,418,639 B2—Mooring system for a vessel WO 2007/127531 A2—Detachable mooring system with bearing mounted on submerged buoy U.S. Pat. No. 7,959,480 B2—Detachable mooring and fluid transfer system U.S. Pat. No. 7,717,762 B2—Detachable mooring system with bearings mounted on submerged buoy US 2004/0159276 A1—Method for installing a self-floating deck structure onto a buoyant structure GB 2253813 A—Production buoy GB 2008051 A—Self-stabilising multi-column floating tower WO 2006/066871 A2—Floating vessel for deep water drilling and production WO 2002/092425 A1—Floating multipurpose platform structure and method for constructing same

The invention claimed is:

1. A floating production unit configured to be unmanned during normal production operations, the floating production unit comprising:

a deck structure for mounting equipment for processing hydrocarbons; and a hull structure comprising:

first section formed as a cylindrical like structure with a first diameter, the first section having a first ratio of the first diameter divided by a height of the first section, and a deck mounting portion formed in an upper part of the first section to which the deck structure is configured to be attached, a central axis of the first section being substantially perpendicular to a horizontal plane of the deck structure;

a second section formed as a cylindrical like structure with a second diameter, the second diameter being configured to be between 1.1 and 2.5 times that of the first diameter, the second section having a second ratio of the second diameter divided by a height of the second section, the height of the second section being configured to be between 0.2 and 1.6 times that of the height of the first section, the second section being mounted below the first section and arranged such that a central axis of the second section aligns with the central axis of the first section, wherein the second section is configured when in use to be fully immersed; and a plurality of storage cells operable to store ballast when the floating production unit is in use, the ballast in the storage cells in cooperation with geometry of the hull structure providing a displacement to allow the floating production unit to float when in use to produce a heave natural period of the floating production unit corresponding to a period above which there is less than 15% of a total wave spectral energy in an extreme wave environment at an offshore location of the floating production unit.

2. A floating production unit as claimed in claim 1, wherein an immersed volume of the second section is configured to be between 0.2 and 3.5 times that of the immersed volume of the first section.

3. A floating production unit as claimed in claim 1, wherein the first ratio is configured to be between 0.2 and 2.5.

4. A floating production unit as claimed in claim 1, wherein the second ratio is configured to be between 1.0 and 8.0.

5. A floating production unit as claimed in claim 1, wherein the ballast comprises salt water, or high-density pumpable ballast with a specific gravity of 2 or more, or salt water and high density pumpable ballast with a specific gravity of two or more.

6. A floating production unit as claimed in claim 1, wherein the equipment for processing hydrocarbons which is mounted on the deck structure comprises equipment which is specified and configured for unmanned operations.

7. A floating production unit as claimed in claim 1, wherein the floating production unit further comprises a central access tube providing a conduit for risers and umbilicals between the production equipment on the deck structure and one or more subsea wells.

8. A floating production unit as claimed in claim 1, wherein the second section comprises an upper portion and a lower portion, the upper portion being closer to the first section than the lower portion, the storage cells being in the lower section and not extending to the upper section.

9. A floating production unit as claimed in claim 1, wherein the second section includes an air skirt for providing a recess in the second section for adjusting the buoyancy of the floating production unit, the recess being enclosed within the second section and defining a third diameter, the second diameter being greater than the third diameter.

10. A floating production unit as claimed in claim 1, further comprising at least one pump, or at least one compressor, or at least one pump and at least one compressor and one or more risers for exporting processed hydrocarbons.

11. A floating production unit as claimed in claim 1, wherein a draught of the hull structure and the deck structure of the floating production unit is configured to be no more than 5 meters at launch at their construction sites.

12. A floating production unit as claimed in claim 1, wherein a heave response of the floating production unit is configured to be above 15 seconds when in use.

13. A floating production unit as claimed in claim 1, wherein a cross section of at least one of the sections is substantially circular.

14. A floating production unit as claimed in claim 1, wherein a cross section of at least one of the sections is substantially oval.

15. A floating production unit as claimed in claim 1, wherein a cross section of at least one of the sections is substantially polygonal.

16. A floating production unit as claimed in claim 1, wherein the deck structure is buoyant.

17. A method of installing a floating production unit configured to be unmanned during normal production operations, the method comprising:

fabricating, launching and towing a hull structure forming part of the floating production unit to an offshore site, the hull structure comprising:

a first section formed as a cylindrical like structure comprising straight parallel sides providing the first section with a uniform cross section with a first diameter, the first section having a first ratio of the first diameter divided by a height of the first section, and a deck mounting portion formed in an upper part of the first section to which a deck structure for mounting equipment for processing hydrocarbons is attachable, a central axis of the first section being substantially perpendicular to a horizontal plane of the deck structure;

a second section formed as a cylindrical like structure comprising straight parallel sides providing the second section with a uniform cross section with a second diameter, the second diameter being configured to be between 1.1 and 2.5 times that of the first diameter, the second section having a second ratio of the second diameter divided by a height of the second section the height of the second section being configured to be between 0.2 and 1.6 times that of the height of the first section, the second section being mounted below the first section and arranged such that a central axis of the second section aligns with the central axis of the first section, wherein the second section is configured when in use to be fully immersed; and a plurality of storage cells operable to store ballast when the floating production unit is in use, the hull structure providing a displacement to allow the floating production unit to float when in use, to produce a heave natural period of the floating production unit corresponding to a period above which there is less than 15% of a total wave spectral energy in an extreme wave environment at the offshore site of the floating production unit;

mooring the hull structure to the sea bed;

ballasting the hull structure such that the hull structure is at least partially submerged;

fabricating, launching and towing the deck structure forming part of the floating production unit to the offshore site independently to the hull structure and such that the deck structure is positioned directly above the at least partially submerged hull structure;

pulling the at least partially submerged hull structure towards the floating deck structure; connecting the hull structure to the deck structure to construct the floating production unit; and de-ballasting the floating production unit to an operational level.

18. A method as claimed in claim 17, wherein the launching and towing the hull structure further comprises using a sub-divided air cushion for buoyancy.

19. A method as claimed in claim 17, wherein the mooring the hull structure to the sea bed is performed by either a catenary mooring system, a semi-taught mooring system or a taught mooring system comprising a combination of a ground chain or wire section, a synthetic rope or wire mid-section and an upper chain or wire section.

20. A method as claimed in claim 17, wherein subsequent to the mooring the hull structure to the sea bed, the method further comprising installing a plurality of flexible flow-line risers and umbilical cables to connect the floating production unit to one or more subsea wells.

21. A method as claimed in claim 17, wherein the ballasting the hull structure further comprises using high-density pumpable ballast.

* * * * *